United States Patent [19]

Eiermann

[11] Patent Number: 4,715,799

[45] Date of Patent: Dec. 29, 1987

[54] COMPOSITE CONSTRUCTION OF CASING FOR ROTARY PISTON ENGINE

[75] Inventor: Dankwart Eiermann, Weissensberg, Fed. Rep. of Germany

[73] Assignee: Wankel GmbH, Berlin, Fed. Rep. of Germany

[21] Appl. No.: 856,688

[22] Filed: Apr. 25, 1986

[30] Foreign Application Priority Data

Apr. 25, 1985 [DE] Fed. Rep. of Germany ..... 3514913

[51] Int. Cl.[4] ..... F01C 1/22; F01C 21/10; B22D 19/00

[52] U.S. Cl. ..... 418/61 A; 418/83; 418/178; 418/179; 29/156.4 WL; 164/98; 164/111

[58] Field of Search ..... 418/61 A, 83, 178, 179; 164/98, 103, 105, 111; 29/156.4 WL, 527.5

[56] References Cited

U.S. PATENT DOCUMENTS

| | | | |
|---|---|---|---|
| 11,704 | 11/1898 | Haugh et al. | 164/111 |
| Re. 29,806 | 10/1978 | Iida et al. | 418/178 |
| 3,705,818 | 12/1972 | Grosseau | 418/178 |
| 3,745,854 | 7/1973 | Haag et al. | 418/178 |
| 4,599,772 | 7/1986 | Graham | 164/98 |

FOREIGN PATENT DOCUMENTS

| | | | |
|---|---|---|---|
| 59-153925 | 9/1984 | Japan | 418/178 |
| 1023122 | 6/1983 | U.S.S.R. | 418/179 |

*Primary Examiner*—John J. Vrablik
*Attorney, Agent, or Firm*—Becker & Becker, Inc.

[57] ABSTRACT

A housing mantle or casing produced in a compact construction for a rotary piston engine with a trochoidal-shaped dual-arc mantle runway or raceway and sealing strips arranged in corners of a triangular piston rotating upon an eccentric of an eccentric shaft so that the sealing strips slide along the mantle runway. A layer of steel forming the mantle runway and an outer layer of aluminum alloy is cast around the layer of steel. The layer or band of steel forming the runway has openings with radially outwardly bent-open edges which are cast of filled-out with cast metal forming the outer layer as far as to a plane which coincides with a base plane of the steel layer or band forming the mantle runway.

7 Claims, 5 Drawing Figures

COMPOSITE CONSTRUCTION OF CASING FOR ROTARY PISTON ENGINE

BACKGROUND OF THE INVENTION

1. Field of the Invention

The present invention relates to composite construction of a casing, Jacket, shell or housing of a rotary piston engine with a trochoidal-shaped dual-arc casing raceway and a triangular piston rotating upon an eccentric of an eccentric shaft and including sealing strips arranged in the corners of the triangular piston, such sealing strips riding along this casing raceway which consists of a layer of steel forming the casing raceway and an outer layer of an aluminum alloy cast around this layer of steel forming the mantle or casing raceway.

2. Description of the Prior Art

Such arrangements have a purpose, on the one hand to simplify production via avoidance of chip-removing, grinding machining of the raceway proceeding in a trochoidal shape, and on the other hand to obtain a hard, mantle or casing raceway resistant to impact stress or load via the radial sealing strips of the piston in a casing or housing mantle of aluminum alloy good for dissipating the heat.

In the prior art, U.S. Pat. No. 3,937,266-Cordone et al dated Feb. 10, 1976 discoses a method for application of wear-resistant coating involving a procedure of so-called transferred molding or transplant procedure according to which around a mold core forming the negative mold of the mantle or housing raceway there is built up a hard layer forming the mantle raceway via metal spraying, plasma spraying or in an electrochemical application procedure, which is removed and placed around a core identical with the aforementioned mold core which results in the inner tool of a cast mold for the housing mantle. The fluid or liquid aluminum pressed into the casting mold binds or connects itself with the layer forming the outer surface of the raceway, runway, path or course for engagement by the sealing strips of the triangular piston.

In order to obtain a better, most of all binding or connection withstanding the changing or variation of heat loading during operation between the highly carbonaceous or carbon-rich steel and the aluminum alloy, there was proposed to produce the layer forming the runway or raceway out of a steel band or strip which is welded together into a trochoidal-shaped ring into the outer side of which there is struck or rolled an arrow-type tooth means. The connection surface of the two metals is enlarged thereby and the housing mantle or shell consisting of aluminum is anchored better in the layer forming the runway or raceway (Japanese Patent Application No. Sho-52-123776 of Oct. 15, 1977 and Japanese Patent Application No. Sho-53-22383 of Feb. 28, 1978).

Via these measures, however, on the one hand, the difficulties which result via the greater heat expansion of aluminum with respect to the inner layer consisting of an iron alloy and on the other hand those resulting via the poor or inferior heat conduction of the inner layer, also cannot be eliminated via the described tooth means of the two materials, most of all not in the ranges or region of highest procedural temperatures. Accordingly, material cracks or fissures and layer separation can show up and be encountered especially around the seat of the spark plug. An important and considerably disadvantage additionally is that the heat transfer or conveyance to the cooling system as a whole is hindered, obstructed or restrained by the closed steel layer.

SUMMARY OF THE INVENTION

An object of the present invention on the one hand is to attain a secure mechanical binding between the steel layer forming the runway or raceway and the aluminum of the housing mantle or shell and on the other hand to make possible a direct heat transfer or transmission from the operating or working chambers to the cooling system having the housing mantle or shell made out of an aluminum alloy.

The solution of this object results via the features of the present invention including the arrangement of a layer forming the raceway or runway and having such layer of steel having openings with radially outwardly bent-open edges which are cast-out with cast metal forming the outer layer as far as to a plane which is identical with the base plane of the layer forming the mantle or shell raceway or runway for the sealing strips of the triangular rotary piston.

The mantle raceway or runway according to the present invention with the bent-open edges of the openings provided therein results in provision of a stable, undercut dovetailshaped anchoring of the aluminum casting, which can only be reinforced or strengthened via the mechanical loading by the impinging or striking sealing strips and which withstands the unequal heat expansions. The radial strips always run or engage along the inner base surface of the layer of steel forming the mantle or shell raceway or runway of the casing and the radial strips consequently with the impact movements thereof cannot penetrate into the openings in the exposed surfaces of the aluminum. The offset or displaced arrangement of the openings overlapping in operating or running direction prevents any nonuniform or uneven wear, removal or abrasion of the mantle or shell raceway in longer operation. The exposed aluminum surfaces on the other hand make possible a direct heat transfer from the operating or working chamber to the cooling system which is a considerable and important advantage of the present invention.

Circular openings or other shapes also can be provided rather than oblong or slotted holes, although corners are to be avoided because of the strength reduction resulting thereby.

The number of openings per surface unit can be matched or adapted to the heat loading or thermal stress of the respective or particular segment of the housing mantle or shell. Thus, fewer such openings can be provided in the cold arc and more such openings can be provided in the hot arc or curvature in order to improve the heat dissipation in the hot regions and with that in order to reduce the heat stress between the two metals. Accordingly, a greater number of openings can be provided primarily and most of all in the region of the spark plug seat and especially also a smaller number of openings can be provided respectively elsewhere.

This object, and other objects and advantages of the present invention, will appear more clearly from the following specification in conjunction with the accompanying drawings.

BRIEF DESCRIPTION OF THE DRAWINGS

Referring now to the drawings in detail, FIG. 1 shows a rotary piston engine including a steel band or strip illustrated in FIGS. 2 and 3 having punched or stamped-in oblong holes or slots 2 extending in running direction, such oblong holes or slots along an edge 3 thereof being bent open radially outwardly in vertical section being in a quarter circle or quadrant, which can be produced by punching, stamping and pressing in a simple and straightforward manner in a rolling procedure.

FIG. 4 shows a section or segment of a mantle raceway or runway according to the present invention into which the steel band or strip 1 shown in FIGS. 1 and 2 has the aluminum alloy of the housing mantle cast therein. The cast metal 4 is shown as having penetrated in a mushroomshape or dovetail-shape into the elongated holes or slots 2 as far as to the surface of the cast-mold core to a plane 5 which is equal or identical with the base plane 6 of the steel band or strip 1 and which together form the runway or raceway left remaining during formation of the elongated holes or slots 2.

FIG. 5 shows a mantle runway or raceway according to the present invention in the region of the seat 7 of a spark plug. The elongated holes or slots 2 here are distributed corresponding to the temperature or heat gradient (drop in temperature or rate of decrease in temperature) in the operating or working chamber during the operation, accordingly being most dense around the seat 7 of the spark plug and with decreasing density in the hot arc or curvature 8, with smaller or more nominal density in the preceding cold arc or curvature 9.

Figure 1:
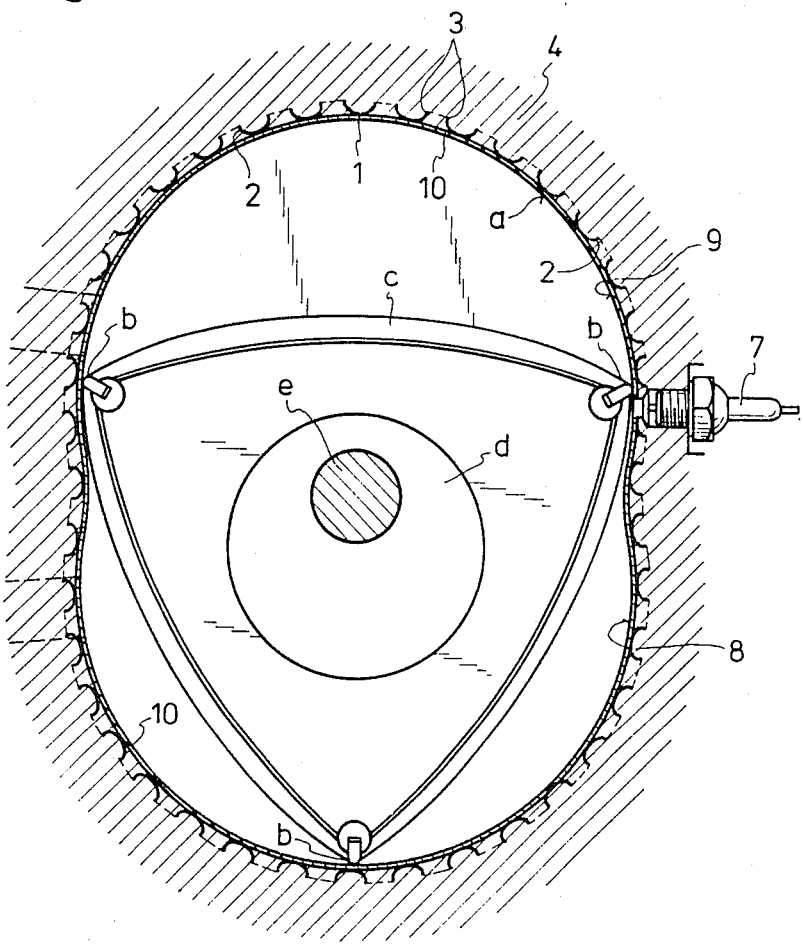
FIG. 1 is a radial cross sectional view of a rotary piston engine having features in accordance with the present invention.
Figure 2:
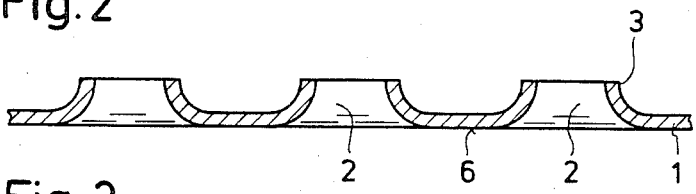
FIG. 2 is a view that shows a radial partial section through a steel band or strip according to the present invention out of which the layer forming the runway or raceway for the sealing strips of the triangular rotary piston is welded together into a trochoidal-shaped ring.
Figure 3:
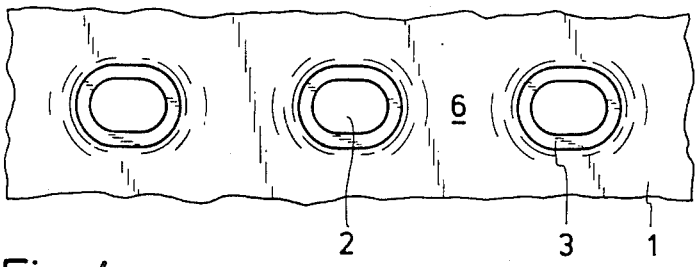
FIG. 3 is a plan view upon the runway or raceway side of the same steel band or strip.
Figure 4:
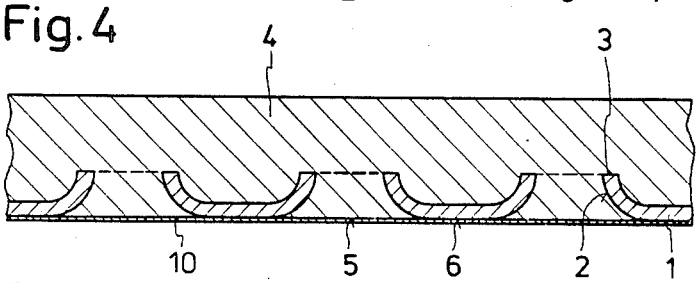
FIG. 4 is a view showing a radial partial section through a mantle runway or raceway having features in accordance with the present invention.
Figure 5:
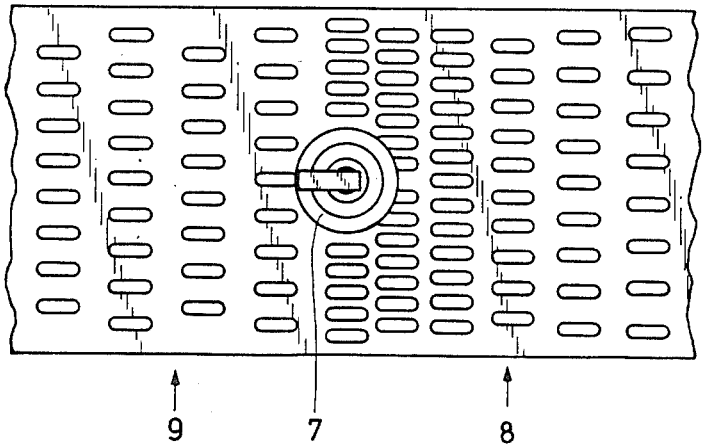
FIG. 5 is a plan view onto a mantle runway or raceway according to the present invention in the region of the spark plug as seen from radially inside thereof.

The mantle runway or raceway engaged by the sealing strips of the triangular rotary piston can be provided with a running layer, which for example can be made of a mixture of nickel and a fine hard granular material which is applied in an electrochemical application procedure. A uniform bonding to the base surface of the steel band or strip and on the aluminum surfaces can be attained in the openings as well as a uniform application of the coating or layering 10 being attained thereby that initially a thin layer of a good electrical conducting metal is applied.

The casting of the aluminum housing mantle or shell can occur in a transplant procedure, with which a section or segment of steel strip or band perforated in accordance with the present invention and welded together at ends thereof into a trochoidal-shaped ring is placed around a core of a die cast metal mold for the housing mantle or shell, such core forming a negative shape or mold of the mantle runway or raceway and then this die case metal mold is cast with an aluminum alloy.

The runway or raceway is formed by a layer of steel or steel band 1 having openings 2 with radially outwardly bent-open edges 3 which are cast- or filled-out with a cast metal forming an outer layer 4 as far as to a plane 5 which is identical or equal with the base plane 6 of the layer or steel band 1 forming the mantle runway or raceway for the sealing strips of a mantle raceway or runway of a casing or housing of a rotary piston engine. The openings 2 are slots or elongated holes extending in the running direction. The openings 2 are arranged in a formation or association displaced or offset among each other.

The edges 3 of the openings 2 are bent open in a quadrant or quarter-circular shape. The openings 2 are arranged closer together or in a more dense location and arrangement corresponding to increasing heat loading or thermal stress of the housing mantle or shell. The openings 2 in the vicinity of the seat 7 of the spark plug are smaller than the remaining openings 2 and are arranged closer or more densely than these are. The runway or raceway has a thin layer of good electrically conducting material and over this an electrochemically applied runway coating or layering 10.

The present invention is, of course, in no way restricted to the specific disclosure of the specification and drawings, but also encompasses any modifications within the scope of the appended claims.

What I claim is:

1. A housing mantle made in a composite construction for a rotary piston engine with a trochoidal-shaped two-arc mantle runway and a triangular piston having sealing strips arranged in corners thereof gliding along this mantle runway, such triangular piston rotating upon an eccentric of an eccentric shaft, comprising:
   - a layer of steel forming the mantle runway;
   - an outer layer of an aluminum alloy cast around this layer, said layer of steel forming the mantle runway having openings therein including radially outwardly bent-open edges therewith; and
   - a cast metal forming said outer layer and cast to be filled-out as far as to a plane which coincides with a base plane of said layer forming said mentle runway so as to establish considerably improved direct heat-conducting contact between the mantle runway and aluminum of said housing mantle via the edges of the openings.

2. A housing mantle according to claim 1, wherein said openings are elongated-hole slots extending in running direction.

3. A housing mantle according to claim 1, in which said openings are arranged in offset association among each other.

4. A housing mantle according to claim 1, in which said edges of the openings are bent open in a quadrant quarter circle in section at right angles to the runway.

5. A housing mantle according to claim 1, in which said openings are arranged closer together corresponding to increasing thermal stress of the housing mantle.

6. A housing mantle according to claim 5, wherein said openings are smaller in the vicinity of the seat of a spark plug when compared with the remaining openings and are arranged more closely and densely than these are.

7. A housing mantle according to claim 1, wherein said runway consists of a thin layer of good electrically conducting material and over this having an electrochemically applied runway coating.

* * * * *